US009109375B2

(12) United States Patent
Martin et al.

(10) Patent No.: US 9,109,375 B2
(45) Date of Patent: Aug. 18, 2015

(54) BUILDING STRUCTURE HAVING IMPROVED HOUSEHOLD LAUNDRY FUNCTIONS

(76) Inventors: Bonnie C. Martin, Columbia, SC (US); James Martin, Columbia, SC (US)

( * ) Notice: Subject to any disclaimer, the term of this patent is extended or adjusted under 35 U.S.C. 154(b) by 1627 days.

(21) Appl. No.: 11/690,545

(22) Filed: Mar. 23, 2007

(65) Prior Publication Data

US 2008/0086980 A1 Apr. 17, 2008

Related U.S. Application Data

(60) Provisional application No. 60/785,322, filed on Mar. 23, 2006.

(51) Int. Cl.
*E04B 1/00* (2006.01)
*E04H 1/02* (2006.01)

(52) U.S. Cl.
CPC ..... *E04H 1/02* (2013.01)

(58) Field of Classification Search
CPC ..... E04H 1/02
USPC ..... 52/234, 169.1, 169.2, 169.3, 169.4
See application file for complete search history.

(56) References Cited

U.S. PATENT DOCUMENTS 1,175,947 A 3/1916 Frederickson
1,222,963 A 4/1917 Matchette
1,342,269 A 6/1920 Stewart (Continued)

FOREIGN PATENT DOCUMENTS

JP 2000257289 A * 9/2000 ..... E04H 1/02
JP 2001087051 A * 4/2001 ..... A47B 61/00

(Continued)

OTHER PUBLICATIONS

Meridian at Carlyle, Nov. 1, 2003 http://web.archive.org/web/20031101153117/www.meridiancarlyle.com/floorplans/fairfax.html.*

(Continued)

*Primary Examiner* — Brent W Herring
(74) *Attorney, Agent, or Firm* — Nelson Mullins Riley & Scarborough LLP

(57) ABSTRACT

Structural elements and features are provided to significantly reduce the time and effort required in the household laundry process of collecting dirty laundry, washing, drying, hanging, and storing laundry. These same structural elements improve the quality of the laundry output. A reduction in time and effort is accomplished by locating a laundry facility central to a plurality of rooms within the building structure and placing closets within the walls separating the laundry facility from the adjacent rooms. These closets are accessible from the laundry facility on one side and the respective room on the other. In another aspect of the invention, rooms that are not directly adjacent to the laundry facility may be located on a hallway common to the laundry facility and the non-adjacent rooms. The walls dividing the non-adjacent rooms from the common hallway may likewise include closets that are accessible from the common hallway on one side and the respective room on the other. In a variation of the present invention the laundry facility is combined with the hallway. Most of the rooms where the laundry will be used are adjacent to the laundry facility/hallway combinations. The walls dividing the rooms from the hallway may likewise include closets that are accessible from the hallway on one side and the respective room on the other.

21 Claims, 13 Drawing Sheets

(56) References Cited

U.S. PATENT DOCUMENTS

| | | | | | |
|---|---|---|---|---|---|
| 2,278,843 | A * | 4/1942 | Rogers | 454/232 |
| 2,660,269 | A | 11/1953 | Whitehouse | |
| 2,787,310 | A * | 4/1957 | Zerbe | 220/9.3 |
| 2,790,209 | A | 4/1957 | Thompson | |
| 3,128,866 | A | 4/1964 | Ratowsky | |
| 3,169,382 | A * | 2/1965 | Brown | 62/259.1 |
| 3,497,073 | A * | 2/1970 | Bartell | 211/2 |
| 3,552,075 | A * | 1/1971 | Crump | 52/236.3 |
| 3,768,221 | A * | 10/1973 | Fuller | 52/220.2 |
| 3,811,198 | A * | 5/1974 | Baltes | 34/466 |
| 4,278,048 | A | 7/1981 | Klein | |
| 4,718,205 | A * | 1/1988 | Taylor | 52/79.8 |
| 4,745,719 | A * | 5/1988 | Blankstein et al. | 52/234 |
| 5,003,750 | A * | 4/1991 | Delgado | 52/741.11 |
| 5,294,009 | A * | 3/1994 | Maurer et al. | 211/126.15 |
| 5,694,725 | A * | 12/1997 | Kaufman et al. | 52/236.3 |
| 6,079,216 | A | 6/2000 | de Marsillac Plunkett | |
| 6,244,003 | B1 * | 6/2001 | Allison | 52/234 |
| 6,386,194 | B1 | 5/2002 | Christman | |
| 6,565,144 | B1 * | 5/2003 | Crean | 296/168 |
| 6,820,375 | B2 * | 11/2004 | Meeker | 52/36.1 |
| 7,320,200 | B1 * | 1/2008 | Eisner | 52/236.1 |
| 2002/0017117 | A1 * | 2/2002 | Sunshine et al. | 68/3 R |
| 2004/0103596 | A1 * | 6/2004 | Don et al. | 52/79.1 |
| 2005/0198919 | A1 * | 9/2005 | Hester, Jr. | 52/236.3 |
| 2006/0117810 | A1 * | 6/2006 | Kendall et al. | 68/3 R |
| 2006/0286524 | A1 * | 12/2006 | Boyers et al. | 434/262 |
| 2008/0270085 | A1 * | 10/2008 | Stone | 703/1 |

FOREIGN PATENT DOCUMENTS

| | | | | |
|---|---|---|---|---|
| JP | 2001182338 | A * | 7/2001 | E04H 1/02 |
| JP | 2003184327 | A * | 7/2003 | E04H 1/02 |
| JP | 2005/336869 | * | 12/2005 | E04H 1/02 |

OTHER PUBLICATIONS

This Old House, Jun. 2011, p. 86.*

* cited by examiner

BUILDING STRUCTURE HAVING IMPROVED HOUSEHOLD LAUNDRY FUNCTIONS

CROSS-REFERENCE TO RELATED APPLICATION

This application claims priority to previously-filed provisional application Ser. No. 60/785,322 filed Mar. 23, 2006, which is relied on and incorporated herein fully by reference.

BACKGROUND OF THE INVENTION

Many homes have a separate facility or general area for the purpose of cleaning laundry, such as clothes, curtains, linens, dish clothes, and towels. This laundry facility or area typically contains a washer and dryer, clothes racks, and detergents and cleaners. In many homes, the process of washing laundry typically includes: (1) moving dirty laundry from a bedroom or bathroom to the laundry facility; (2) washing and drying the laundry; (3) placing the clean laundry into a container so that it can be returned to its respective bedroom or bath room; (4) folding or hanging the laundry; and (5) placing the laundry in its proper place in the room (such as in a closet or dresser) where it is stored prior to use.

Traditionally, the laundry process required a person to move throughout the house back and forth from the laundry facility to complete his or her task. This process also required significant movement of laundry, as well as handling and folding, increasing both labor and time.

Consequently, there is a need for an invention that can reduce the amount of time required by the person cleaning the laundry and returning it to its proper place in the residence, while at the same time improve the quality and condition of the laundry when returned or stored.

SUMMARY OF THE INVENTION

The present invention provides improved household laundry functions which decrease the overall time and effort of the laundry process of collecting dirty laundry, washing, drying, hanging, and storing laundry. This present invention also improves the quality of the laundry output.

One embodiment of the present invention provides a building structure, typically a house, preferably configured to include five structural elements.

The first structural element is composed of closets, accessible from two sides, herein referred to as "dual access closets." The second and third structural elements relate to the laundry facility and/or the hallway, herein referred to as "the specifically configured laundry facility" and the "the specifically configured hallway," respectively. These elements may also be referred to as the "laundry facility" and "hallway" for ease of explanation. The second structural element is the configuration of the laundry facility and the hallway in a manner that allows full and efficient access to the dual access closets. The third structural element is the narrow width configuration of the laundry facility and hallway.

A fourth structural element is the configuration of the rooms where the laundry will be used, such as bedrooms and dressing rooms, in a manner that allows full and efficient access to the dual access closets. The fifth element of the present invention is the placement of the following in relationship to each other: the laundry facility, the hallway, the dual access closets, and the rooms where the laundry will be used, such as bedrooms, dressing rooms, bathrooms and kitchen.

In one embodiment of the present invention, the specifically configured laundry facility is centrally located among a majority of rooms where the laundry will be used, such as bedrooms, dressing rooms, bathrooms, and kitchen, and is separated from at least some of the adjoining rooms by walls containing dual access closets. The dual access closets can be accessed from both sides: the laundry facility on one side and the adjacent room(s) on the other. Dirty laundry can be collected with minimal or no steps from the closet(s) adjacent to the laundry facility and placed in the washer. Of chief benefit, clean laundry can be hung or shelved from the washer and/or dryer into the closet(s) adjacent to the laundry facility with minimal or no steps. The clean laundry is conveniently accessible to the end-user(s) without any further movement of laundry.

Additionally, the building structure is preferably configured so that rooms that are not directly adjacent to the specifically configured laundry facility, such as bedrooms and bathrooms, are located on a hallway common to the specifically configured laundry facility and the non-adjacent rooms. The specifically configured hallway is configured in a manner so that the wall dividing the non-adjacent rooms from the hallway may include dual access closets accessible from the common hallway on one side and the respective non-adjacent room on the other. The non-adjacent rooms are placed near the laundry facility in order to minimize steps taken in the laundry process.

In a variation of the present invention, also utilizing the above-described five structural elements, the laundry facility is combined with the hallway. Thus, most of the rooms where the laundry is used, such as bedrooms and dressing rooms, are adjacent to the hallway, as well as the laundry equipment. In the presently described embodiment, the specifically configured hallway is used instead of the specifically configured laundry facility. The specifically configured hallway is configured in a manner so that the wall dividing the rooms from the hallway may include dual access closets accessible from the hallway on one side and the respective room on the other.

A significant advantage of the present invention is that the occupants of the bedrooms, dressing rooms, and/or bathrooms are not disturbed during the laundry process of collecting dirty laundry and returning clean laundry.

In another embodiment, the laundry facility is placed adjacent to the kitchen; or in the case of a two story structure, the kitchen is adjacent to the stairway, the top of which is either adjacent to or in close proximity to the laundry facility on the second floor. Laundry and meal preparation are two of the most time-consuming household processes and are frequently performed simultaneously. Therefore, locating these two rooms adjacent to each other benefits both processes. While many homes locate these two rooms adjacent to each other, the present invention offers the advantage of allowing the meal preparer to more quickly return to the kitchen due to the efficiencies of the laundry process. Alternately, if the laundry processor is an office worker or other type worker, the office or other type room may be placed adjacent to the laundry facility.

By way of explanation, several terms used within the present description are defined as follow. As used herein, reach-in closets are closet that do not have an aisle; clothes and other laundry items are removed and stored (hung and shelved) by standing outside of the closet. Walk-in closets, on the other hand, do have an aisle; clothes and other laundry items are removed and stored (hung and shelved) by entering (or walking into) the closet. Laundry movement efficiency, as used herein, refers to the reduction of steps required to collect dirty laundry and return clean laundry to closets, cabinets, shelves, etc. where it will be stored and used in order to reduce the time and effort required in the household laundry process of collecting dirty laundry, washing, drying, hanging, and storing laundry. The terms non-adjacent rooms, non-adjacent dual access closets, and non-adjacent dual access linen cabinets, as used herein, refer to rooms, closets, and cabinets not adjacent to the laundry facility.

Other objects, features, and aspects of the present invention are provided by various combinations and sub-combinations of the disclosed elements, as well as methods of utilizing the same, which are discussed in greater detail below.

BRIEF DESCRIPTION OF THE DRAWINGS

A full and enabling disclosure of the present invention, including the best mode thereof to one of ordinary skill in the art, is set forth more particularly in the remainder of the specification, which makes reference to the accompanying figures, in which.

Figure 1:
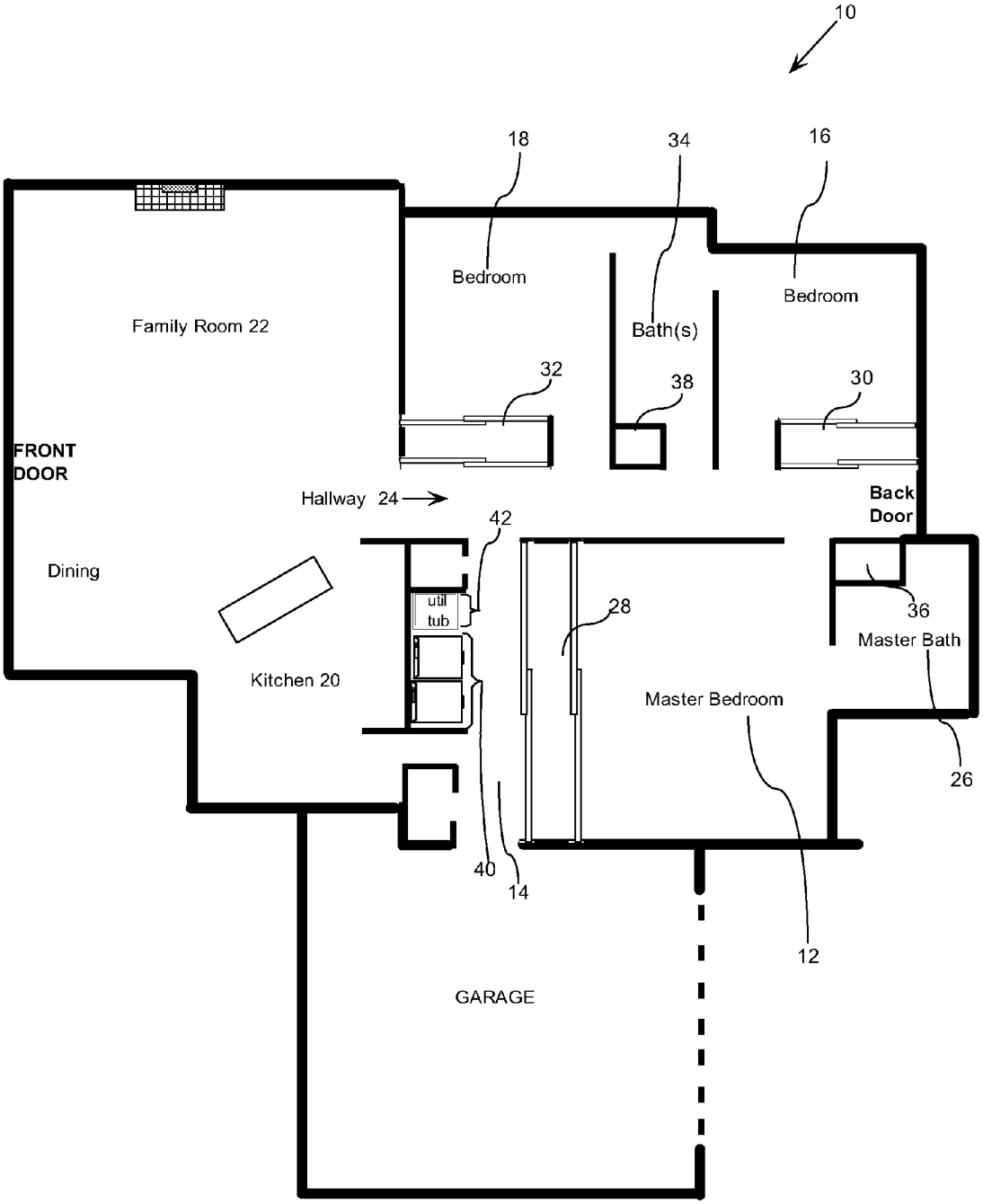
FIG. 1 is a top schematic view of a building structure arranged in accordance with an embodiment of the present invention.

Repeat use of reference characters in the present drawings is intended to represent same or analogous features or elements of the invention.

DETAILED DESCRIPTION OF THE PREFERRED EMBODIMENTS

Reference will now be made in detail to presently preferred embodiments of the invention, one or more examples of which are illustrated in the accompanying drawings. Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on or in another embodiment to yield a still further embodiment. Thus, it is intended that the present invention covers such modifications and variations as come within the scope of the appended claims and their equivalents. Furthermore, the embodiments also contain labels of rooms (e.g., "master bedroom") showing a plausible configuration of the building structure, but it should be understood that these labels are for ease of understanding, and the invention should not be limited to the designs shown and described herein.

FIG. 1 illustrates a building structure 10 constructed in accordance with an embodiment of the present invention. Building structure 10 comprises a number of other structures including a master bedroom 12, a laundry facility 14, bedrooms 16 and 18, kitchen 20, and family room 22. A hallway 24 is adjacent to and connects laundry facility 14, bedrooms 16 and 18, and master bedroom 12. Master bedroom 12 includes a master bath 26 and a dual access closet 28. Bedrooms 16 and 18 include dual access closets 30 and 32, respectively, and are connected by a bath 34 located between the bedrooms. Baths 26 and 34 include dual access linen closets 36 and 38, respectively. Laundry facility 14 includes laundry equipment 40, and, in another embodiment, may include additional laundry equipment 42.

Figure 2:
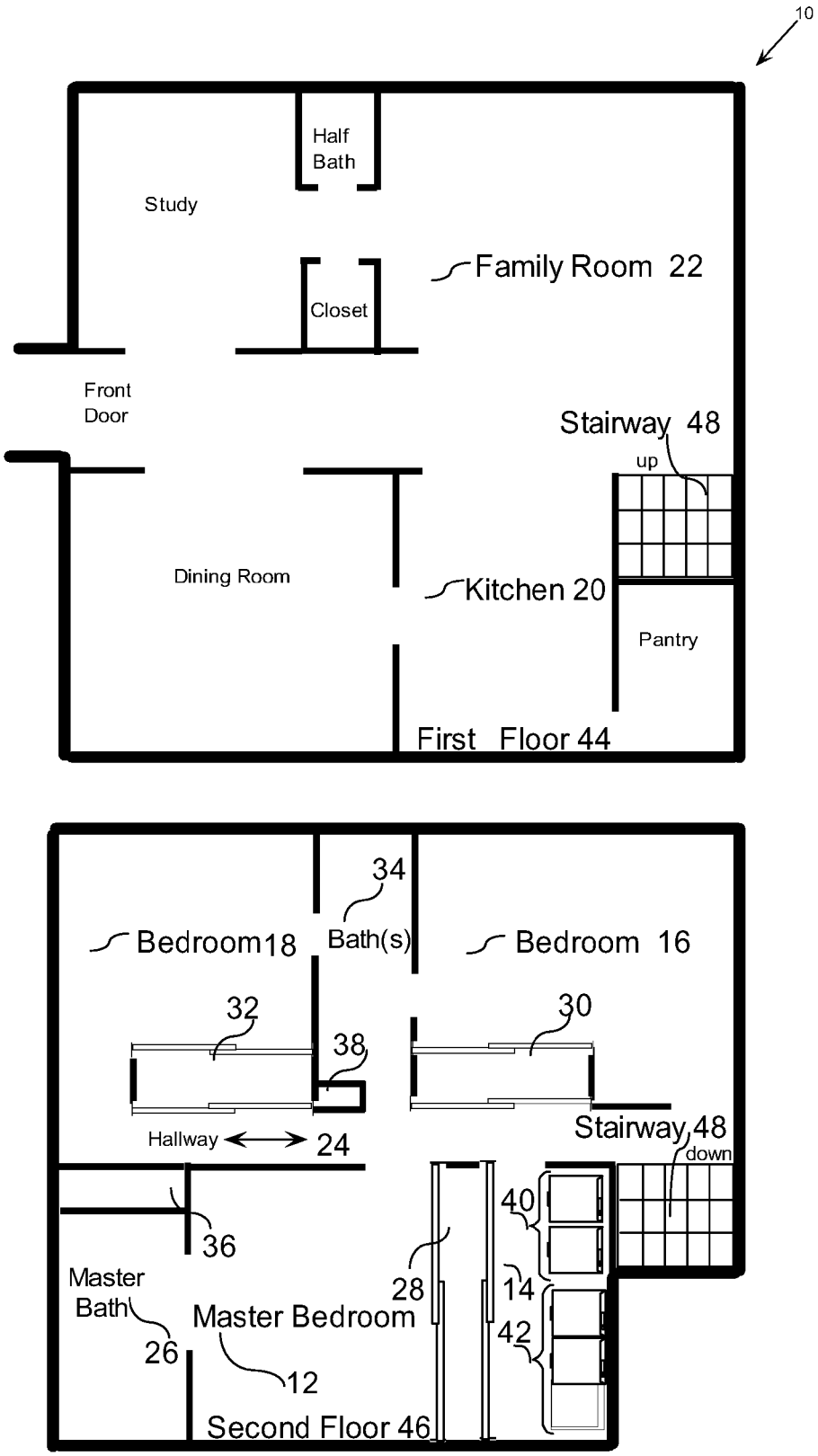
FIG. 2 is a top schematic view of another building structure arranged in accordance with an embodiment of the present invention.

In another embodiment illustrated in FIG. 2, building structure 10 consists of two stories, a first floor 44 and a second floor 46. First floor 44 and second floor 46 are connected by a stairway 48.

Referring to FIGS. 1 and 2, the first structural element presents as dual access closets 28, 30, and 32, as well as dual access linen cabinets 36 and 38. The second structural element configures laundry facility 14 in a manner that allows full and efficient access to the dual access closet 28 from the laundry facility. Thus, the length and height dimensions of the wall in laundry facility 14 common to dual access closet 28 are configured to equal or exceed the length and height dimensions of the opening for dual access closet 28.

To accommodate the non-adjacent rooms and closets, the second structural element configures hallway 24 to allow full and efficient access to dual access closets 30 and 32 from the hallway. Thus, the height of the wall in hallway 24 common to dual access closets 30 and 32 equals or exceeds the height of the respective opening of dual access closets 30 and 32. The length of specifically configured hallway 24 equals or exceeds the combined length of bedrooms 16 and 18 and bath 34.

The third structural element presents as a relatively narrow configuration of specifically configured laundry facility 14. This narrow configuration allows dirty laundry to be collected from dual access closet 28 and made available to laundry equipment 40 and 42 with minimal or no steps. Of chief benefit, this relatively narrow configuration allows clean laundry to be hung or stored into dual access closet 28 from laundry facility 14 with minimal or no steps. While a width of only three feet between laundry equipment 40 and 42 and closet 28 is sufficient for normal laundry processes and provides the greatest degree of laundry movement efficiency, however, a width of more than three feet may be preferred and is acceptable in the present invention. Likewise, specifically configured hallway 24 presents as a narrow configuration (approximately three to four feet) in order to increase laundry movement efficiency for the non-adjacent rooms. It should be understood by one of ordinary skill in the art that laundry facility 14 and hallway 24, as well as the other structures included in building structure 10, may be constructed having other dimensions smaller or larger without departing from the scope and spirit of the present invention.

The fourth structural element configures master bedroom 12 and bedrooms 16 and 18 in a manner that allows full and efficient access to respective dual access closets 28, 30, and 32. Thus, the length and height dimensions of the respective walls in bedrooms 12, 16, and 18 common to respective dual access closets 28, 30, and 32 equal or exceed the length and height dimensions of the respective closets' openings in order to allow full and efficient access to the closets by the occupant (s) of each respective bedroom.

The fifth structural element presents as the placement of specifically configured laundry facility 14 in relationship to dual access closet 28, and the placement of specifically configured master bedroom 12 in relationship to the closet. Laundry facility 14 is located on the side of dual access closet 28 opposite master bedroom 12. Master bedroom 12 is located on the side of dual access closet 28 opposite laundry facility 14. As a result, dual access closet 28 is located between specifically configured laundry facility 14 and specifically configured master bedroom 12 in the manner described above and in such a manner that one side opens to the laundry facility and the other side opens to master bedroom 12.

For the placement of hallway 24 in relationship to laundry facility 14, the fifth structural element presents as the placement of hallway 24 adjacent to laundry facility 14 in order to increase laundry movement efficiency. Dual access closets 30 and 32 are located along hallway 24 near laundry facility 14, as are dual access linen cabinets 36 and 38.

For the placement of hallway 24, dual access closets 30 and 32, cabinets 36 and 38, and non-adjacent rooms 16, 18, 26, and 34 in relationship to one another, the fifth structural element presents as follows: Hallway 24 is located on the side of dual access closets 30 and 32 opposite respective bedrooms 16 and 18. Bedrooms 16 and 18 are placed on the respective side of dual access closets 30 and 32 opposite hallway 24. As a result, dual access closets 30 and 32 are located between specifically configured hallway 24 and respective bedrooms 16 and 18 in the manner described above and in such a manner that one side opens to hallway 24 and the other side opens to the respective bedrooms. In like manner, dual access linen cabinets 36 and 38 open to hallway 24 on one side and respective baths 26 and 34 on the other.

The combination of the five structural elements permits dirty laundry to be collected from dual access closet 28 and made available to laundry equipment 40 and 42 with minimal or no steps and, of chief benefit, permits clean laundry to be removed from the laundry equipment and hung or stored in dual access closet 28 with minimal or no steps. The clean laundry is conveniently accessible to the occupant(s) of master bedroom 12 without any further movement of laundry. The quality of the laundry output benefits from the minimal amount of time that elapses between the time the laundry is removed form equipment 40 and 42 and hung or stored in dual access closet 28 thereby decreasing wrinkles in the laundry output. The quality of the laundry output also benefits from the fact that the laundry will not be transported to another location, decreasing the possibility of soiling and/or wrinkling.

For the non-adjacent dual access closets 30 and 32 and dual access linen cabinets 36 and 38, the combination of the five structural elements allows both dirty laundry to be collected from the closets, as well as from the cabinets, and clean laundry to be hung and stored into the same with minimal steps. The clean laundry is conveniently accessible to the occupant(s) of bedrooms 16 and 18 and bathrooms 26 and 34.

A significant advantage of the present invention is that the occupants of bedrooms 12, 16, and 18 and of bathrooms 26 and 34 are not disturbed during the laundry process of collecting dirty laundry and returning clean laundry.

Still referring to FIG. 1, in another embodiment, laundry facility 14 is located adjacent to kitchen 20. In yet another embodiment as illustrated in FIG. 2, the kitchen is located adjacent to stairway 48, the top of which is located adjacent to laundry facility 14 on the second floor.

Figure 3:
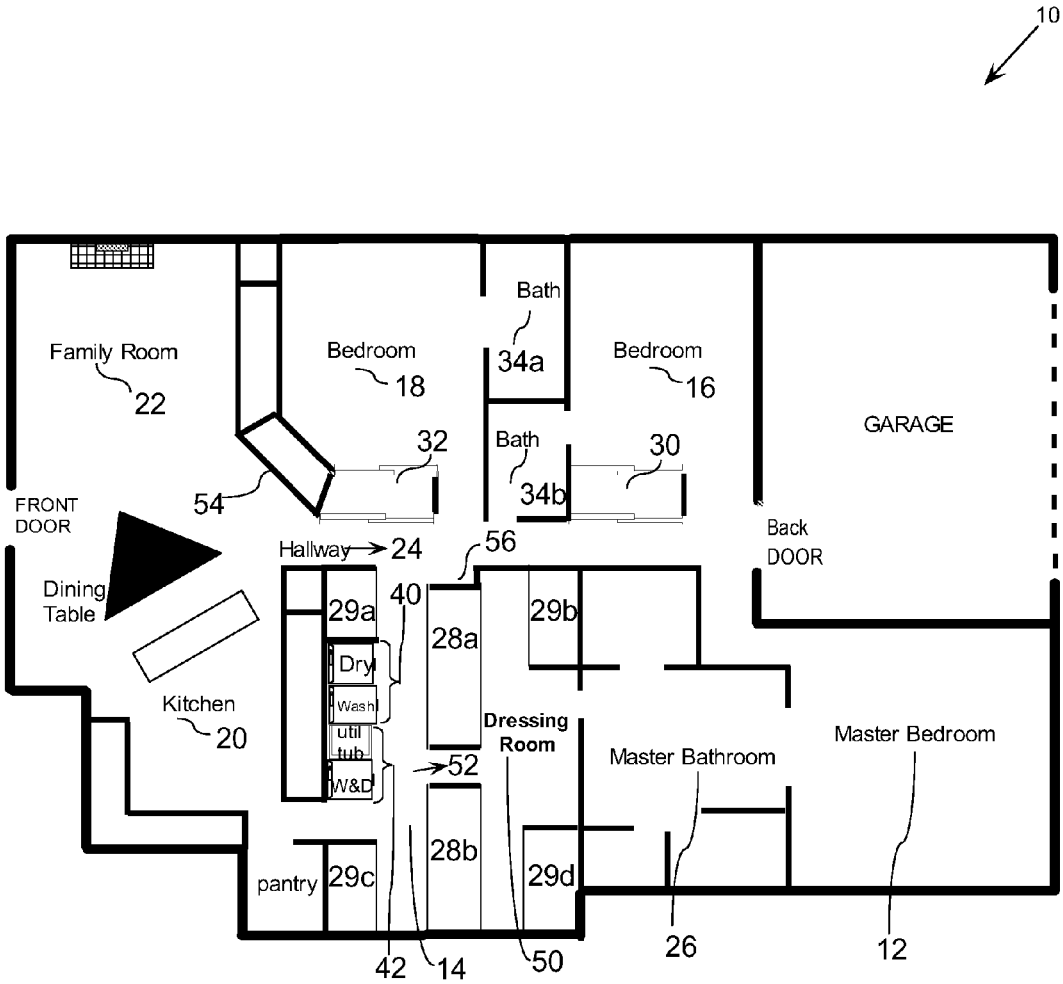
FIG. 3 is a top schematic view of a building structure arranged in accordance with an alternate embodiment of the present invention.

FIG. 3 illustrates a building structure 10. For laundry processing, FIG. 3 is constructed similar to the building structure illustrated in FIG. 1 with the following exceptions. Dressing room 50 is adjacent to dual access closet 28, whereas in FIG. 1, master bedroom 12 is adjacent to dual access closet 28. FIG. 3 also adds passage 52 to allow direct access from laundry facility 14 into dressing room 50. In the presently described embodiment, all closets and laundry storage have been removed from master bedroom 12. Closets within laundry facility 14 and/or dressing room 50 may be enclosed using doors and walls, or may be left open. Closets 29*a*, 29*b*, 29*c*, and 29*d* may be used for hanging laundry or other storage. In yet another embodiment, building structure 10 can include a slanted wall 54 and nook 56, as opposed to being a strictly square design; while these features do not enhance laundry functions, they do illustrate that the invention can present with architectural interest.

Figure 4:
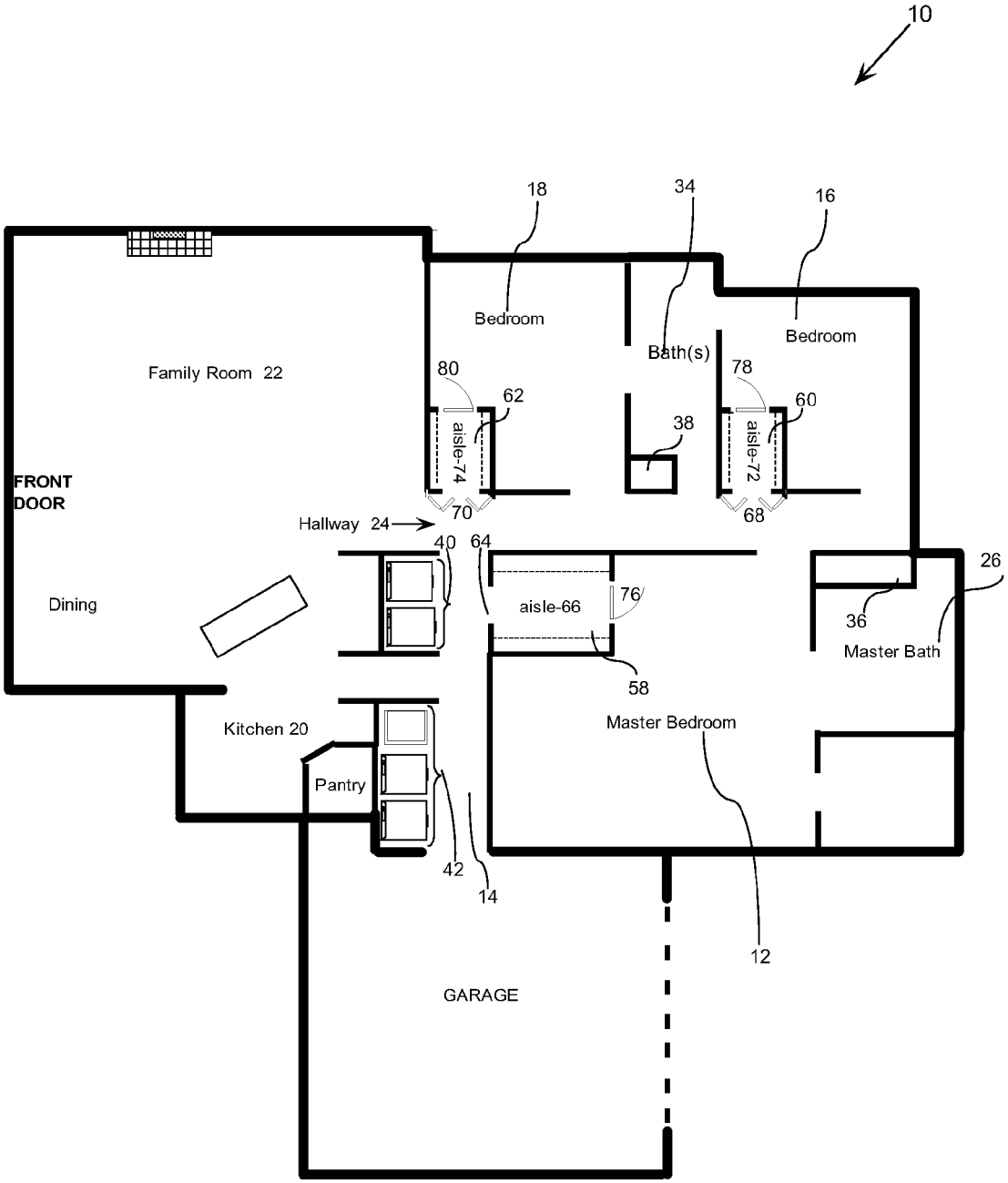
FIG. 4 is a top schematic view of a building structure arranged in accordance with an alternate embodiment of the present invention.

FIG. 4 illustrates building structure 10 constructed similar to the building structure illustrated in FIG. 1 and described above. In another embodiment, dual access closets 28, 30, and 32 (FIG. 1) are replaced by walk-in dual access closets 58, 60, and 62 (FIG. 4), respectively.

The first structural element presents as walk-in dual access closets 58, 60, and 62. Dual access linen cabinets 36 and 38 are also provided. The second structural element configures laundry facility 14 in a manner that allows full and efficient access to the dual access closet 58 from the laundry facility. An opening 64 provides a connection between laundry facility 14 and closet 58, wherein full and efficient access is provided to the closet by placing the opening 64 in line with an aisle 66 of dual access closet 58 and in line with laundry equipment 40.

To accommodate non-adjacent rooms 16 and 18, the second structural element configures hallway 24 to allow full and efficient access to walk-in dual access closets 60 and 62 from the hallway. Full and efficient access from hallway 24 is provided for walk-in dual access closets 60 and 62 by placing openings 68 and 70 in line with respective aisles 72 and 74. In FIG. 4 the doors for openings 68 and 70 are illustrated with bi-fold doors. It should be understood that other types of doors may be used.

The third structural element presents as a relatively narrow configuration of specifically configured laundry facility 14 thereby increasing laundry movement efficiency. While a width of only three feet between laundry equipment 40 and 42 and a solid wall adjacent to master bedroom 12 is sufficient for normal laundry processes and provides the greatest degree of laundry movement efficiency, a width of more than three feet may be preferred and is acceptable in the present invention. Likewise, specifically configured hallway 24 presents as relatively narrow configuration (approximately three to four feet) thereby increasing laundry movement efficiency for non-adjacent bedrooms 16 and 18. It should be understood by one of ordinary skill in the art that laundry facility 14 and hallway 24, as well as the other structures included in building structure 10, may be constructed having other dimensions smaller or larger without departing from the scope and spirit of the present invention.

The fourth structural element configures master bedroom 12 and bedrooms 16 and 18 to allow full and efficient access to respective walk-in dual access closets 58, 60, and 62. Thus, the wall in master bedroom 12 common to walk-in dual access closet 58 provides opening 76 in line with aisle 66 in order to allow full and efficient access to the closet by occupant(s) of the master bedroom. The walls in bedrooms 16 and 18 common to respective walk-in dual access closets 60 and 62 provide respective openings 78 and 80 in line with respective aisles 72 and 74 in order to allow full and efficient access to the closets by occupant(s) of the respective bedrooms.

The fifth structural element is placement of specifically configured laundry facility 14 in relationship to walk-in dual access closet 58, and the placement of specifically configured master bedroom 12 in relationship to the closet. Laundry facility 14 is located on the side of walk-in dual access closet 58 that is opposite master bedroom 12. Master bedroom 12 is located on the side of walk-in dual access closet 58 that is opposite laundry facility 14. As a result, walk-in dual access closet 58 is placed between specifically configured laundry facility 14 and specifically configured master bedroom 12 in the manner described above and in such a manner that one side opens to the laundry facility and the other side opens to the master bedroom.

For the placement of hallway 24 in relationship to laundry facility 14, the fifth structural element presents as the placement of hallway 24 adjacent to laundry facility 14 in order to increase laundry movement efficiency. Walk-in dual access closets 60 and 62 are located along adjacent hallway 24 near laundry facility 14, as are dual access linen cabinets 36 and 38.

For the placement of hallway 24, dual access closets 60 and 62, cabinets 36 and 38, and non-adjacent rooms 16, 18, 26 and 34, the fifth structural element presents as follows: Hallway 24 is located on the side of walk-in dual access closets 60 and 62 opposite respective bedrooms 16 and 18. Bedrooms 16 and 18 are located on the sides of respective walk-in dual access closets 60 and 62 that are opposite hallway 24. As a result, walk-in dual access closets 60 and 62 are located between hallway 24 and respective bedrooms 16 and 18 in the manner described above and in such a manner that openings 68 and 70 open to the hallway and openings 78 and 80 open to bedrooms 16 and 18, respectively. In like manner, dual access linen cabinets 36 and 38 open to hallway 24 on one side and respective bathrooms 26 and 34 on the other. In another embodiment, laundry facility 14 is located adjacent to kitchen 20.

Figure 5:
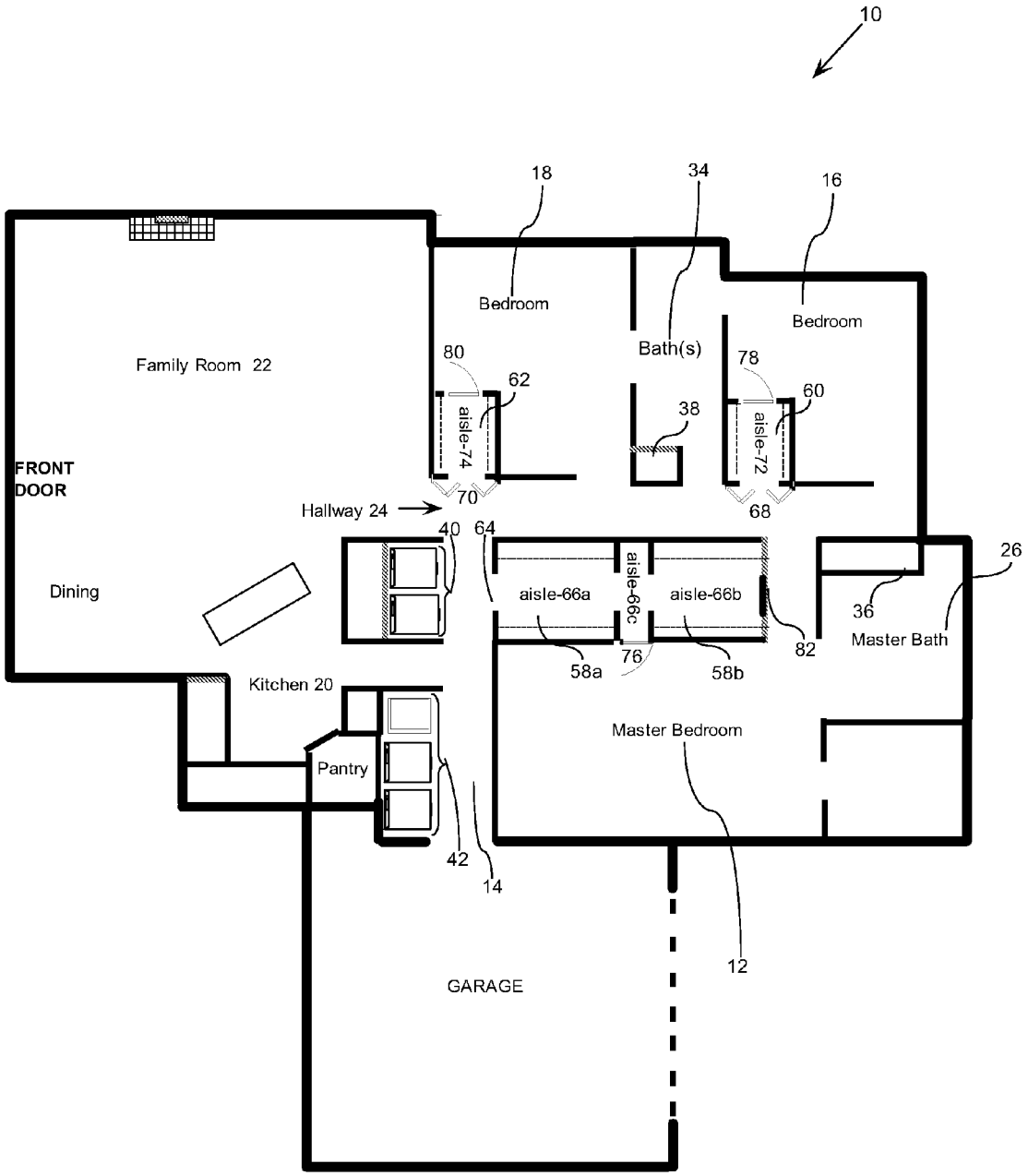
FIG. 5 is a top schematic view of another building structure arranged in accordance with an alternate embodiment of the present invention.

In another embodiment as illustrated in FIG. 5, a building structure 10 is constructed similar to the building structure of FIG. 4. Two walk-in dual access closets 58*a* and 58*b* are added by expanding walk-in dual access closet 58 (FIG. 4). Aisles 66*a* and 66*b* are defined by walk-in dual access closets 58*a* and 58*b*, respectively, and an aisle 66*c* is defined between the closets. Opening 76 provides access to walk-in dual access closets 58 from master bedroom 12 and is inline with aisle 66*c*. In another embodiment, an opening on the wall opposite opening 64 as denoted by shadow lines 82 provides access to walk-in dual access closets 58. It should be understood that opening 82 may be in addition to opening 76 or may replace opening 76 thereby eliminating the need for aisle 66*c*.

Openings 64 and 82 provide full and efficient access to walk-in dual access closets 58 by placing the openings inline with aisles 66*a* and 66*b*. Opening 76 provides full and efficient access to walk-in dual access closets 58 by placing the opening inline with aisle 66*c*. Walk-in dual access closets 58 are located between laundry facility 14 and master bedroom 12 such that the closets are accessible from the laundry facility on one side and the master bedroom on the other allowing improved laundry efficiency as described above. It should be understood by one of ordinary skill in the art that other structural elements of building structure 10 illustrated in FIG. 5 are similar in construction and use as those described above with respect to the building structure shown in FIG. 4.

Figure 6:
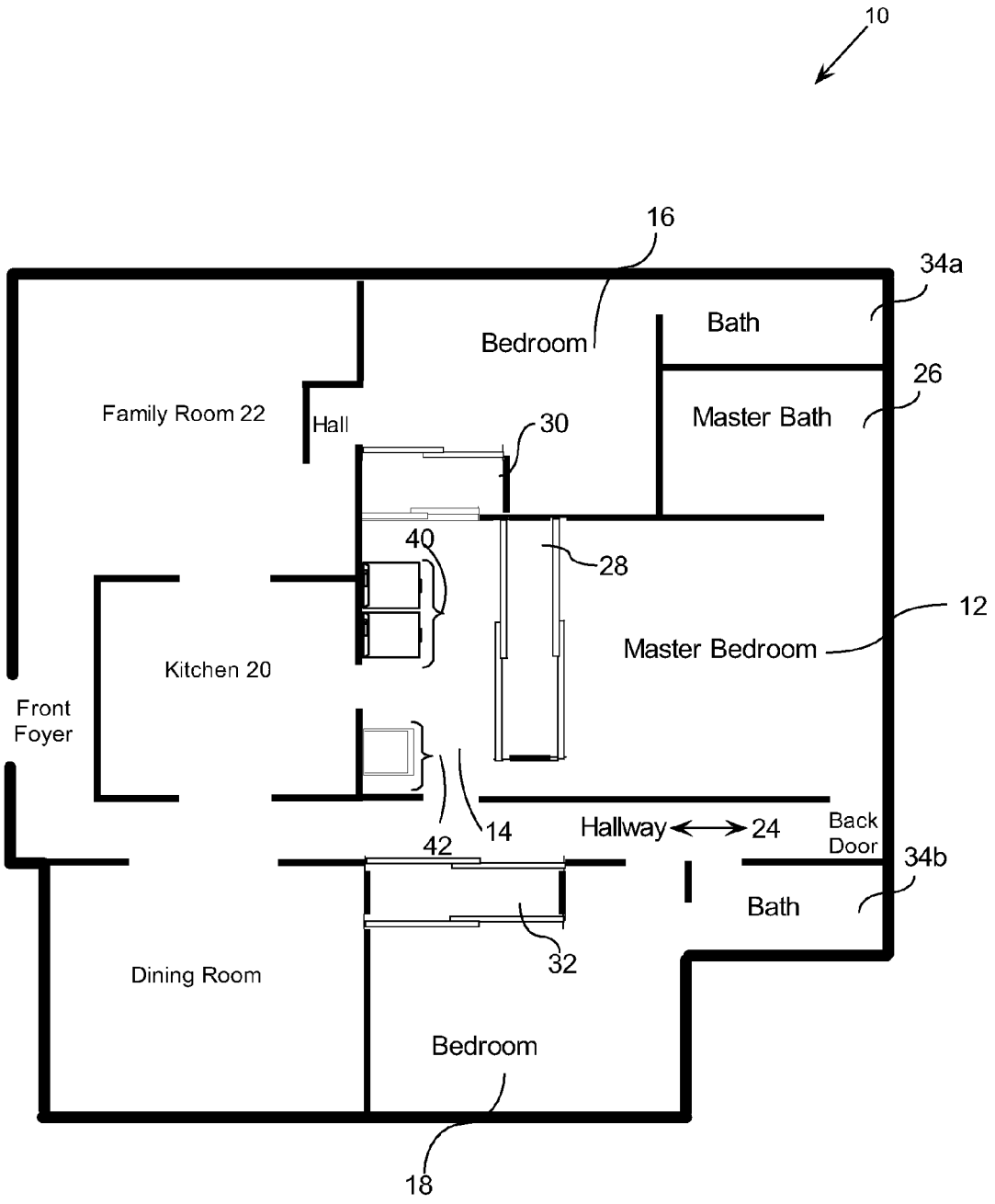
FIG. 6 is a top schematic view of another building structure arranged in accordance with an alternate embodiment of the present invention.

FIG. 6 illustrates a building structure 10. For FIG. 6, description of the five structural elements is similar to FIG. 1 above with the exceptions described as follows. The first structural element presents as dual access closets 28, 30 and 32 as in FIG. 1. However, FIG. 6 offers the advantage of two dual access closets 28 and 30, servicing two bedrooms 12 and 16, adjacent to laundry facility 14 as opposed to only one dual access closet 28 servicing one bedroom 12 adjacent to laundry facility 14 in FIG. 1. As in FIG. 1, dual access closet 32 is directly across hallway 24 from laundry facility 14.

The second structural element configures laundry facility 14 not only to allow full and efficient access to dual access closet 28 as does FIG. 1, but to also allow same for dual access closet 30. Thus, the dimensions of laundry facility 14 are configured to accommodate both closet 28 and 30. Also, laundry facility 14 is configured such that laundry equipment 40 is placed at a distance from the door to closet 30 to allow full and efficient access to dual access closet 30.

In FIG. 6, the third structural element is similar to FIG. 1 in that laundry facility 14 has a relatively narrow configuration.

For FIG. 6, the description of the fourth structural element regarding the configuration of the bedrooms is similar to that of FIG. 1.

For FIG. 6, the fifth structural element differs from FIG. 1 only in the placement of bedroom 16 and corresponding dual access closet 30, in that bedroom 16 is located on the side of dual access closet 30 opposite laundry facility 14, instead of opposite hallway 24 as in FIG. 1. In FIG. 6, the total distance between laundry equipment 40 and 42 and dual access closet 30 is reduced over the distance between same in FIG. 1.

Figure 7:
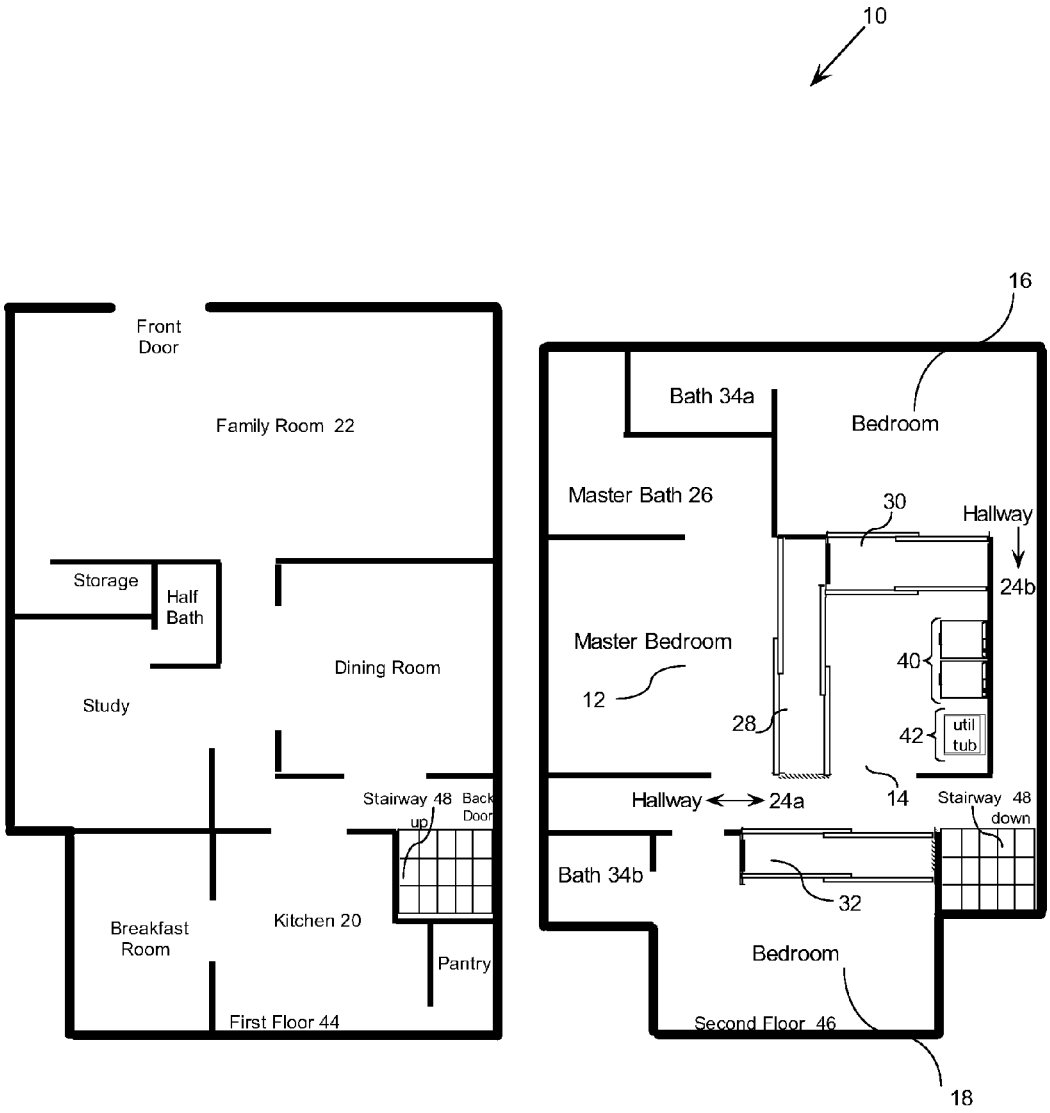
FIG. 7 is a top schematic view of another building structure arranged in accordance with an alternate embodiment of the present invention.

In another embodiment as illustrated in FIG. 7, building structure 10 is a two-story structure. It should be understood by one of ordinary skill in the art that the structural elements of building structure 10 of FIG. 7 are similar in construction and use as those described with respect to building structure 10 of FIG. 6, such that two dual access closets 28 and 30 are adjacent to laundry facility 14 and one dual access closet 32 is directly across hallway 24*a* from laundry facility 14.

Referring to FIG. 6, in another embodiment kitchen 20 is placed adjacent to laundry facility 14 to allow full and efficient access to the kitchen from the laundry facility. Thus the kitchen 20 and the three bedrooms 12, 16 and 18 form a rectangle around the laundry facility providing the shortest distance between the laundry facility and the rooms where the laundry will be used (20, 12, 16, and 18) of all the embodiments presented herein. In FIG. 7, kitchen 20 is located adjacent stairway 48 to allow laundry to be efficiently moved from laundry facility 14 to the kitchen via the stairway.

Figure 8:
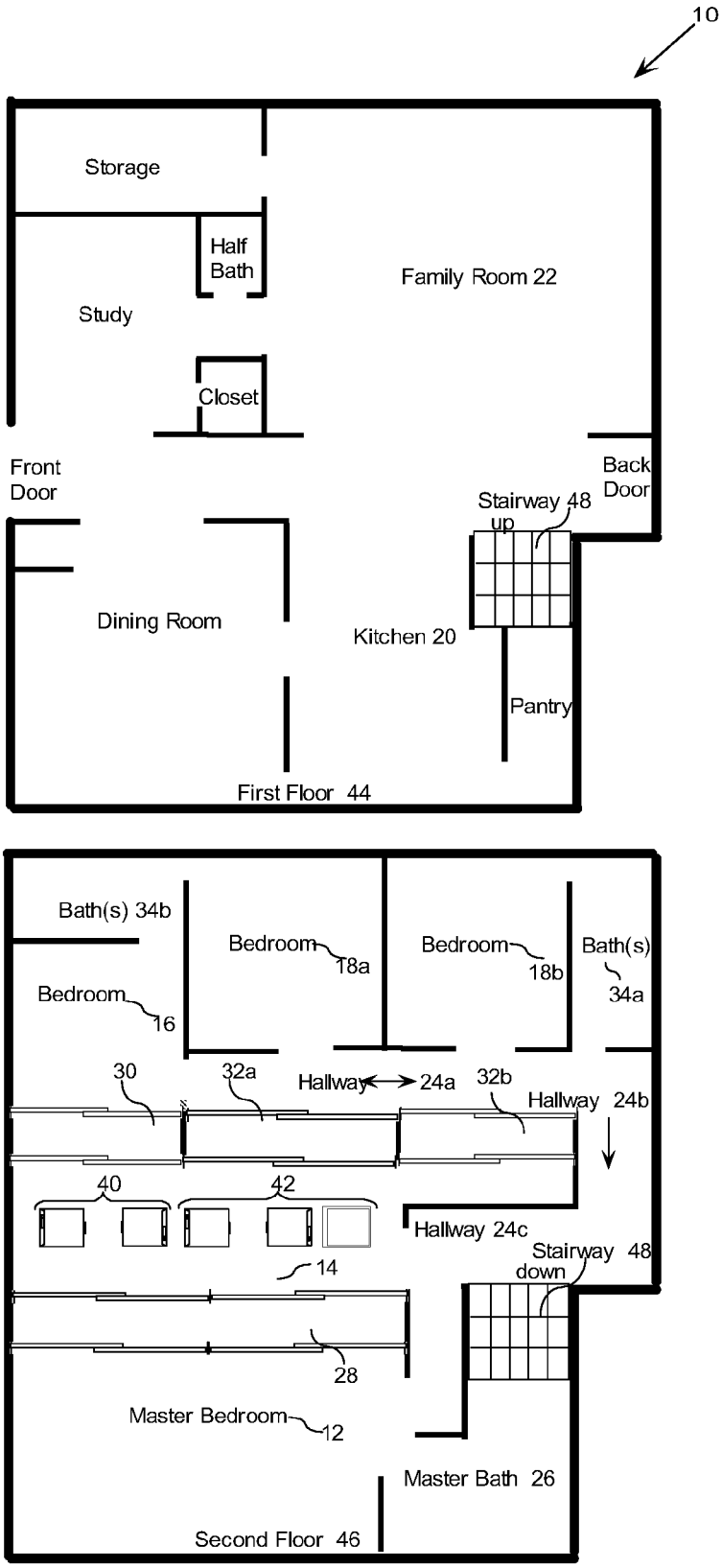
FIG. 8 is a top schematic view of another building structure arranged in accordance with an alternate embodiment of the present invention.

In another embodiment and referring to FIG. 8, building structure 10 is a two-story building structure, which includes four dual access closets 28, 30, 32*a* and 32*b* that present as the first structural element. All four dual access closets are adjacent to laundry facility 14 and are of the reach-in type.

The second structural element configures laundry facility 14 in a manner that allows full and efficient access to dual access closets 28, 30, and 32 from the laundry facility. Thus, the height dimension of the walls in laundry facility 14 common to respective dual access closets 28, 30, and 32 is configured to equal or exceed the height dimension of the closets' respective openings. Also the length dimension of the wall in laundry facility 14 common to dual access closet 28 equals or exceeds the length of closet 28 and the length dimension of the wall in the laundry facility common to dual access closets 30 and 32 equals or exceeds the combined length of closets 30 and 32.

The third structural element presents as a narrow configuration of specifically configured laundry facility 14. Because dual access closet 28 is parallel to dual access closets 30 and 32, and vise versa, access from all dual access closets to laundry equipment 40 and optional laundry equipment 42 is best accomplished by placing the laundry equipment in the middle of the laundry facility with the fronts of the washer and dryer facing each other and at distance from each other that allows passage when the doors to the laundry equipment are open. This configuration allows both dirty laundry to be collected from dual access closets 28, 30, and 32 and clean laundry to be hung or stored into same with minimal or no steps.

The fourth structural element configures master bedroom 12 and bedroom 16 in a manner that allows full and efficient access to respective dual access closets 28 and 30. Thus the length and height dimensions of the respective walls in bedrooms 12 and 16 common to respective dual access closets 28 and 30 equal or exceed the length and height dimensions of respective openings to the closets in order to allow full and efficient access to the closets by occupants of the bedrooms. Since dual access closet 32 opens to hallway 24*a* instead of bedroom 18, the fourth structural element configures hallway 24*a* in a manner that allows full and efficient access to the closet. Thus the height dimension of the wall in hallway 24*a* common to dual access closet 32 equals or exceeds height dimensions of the openings to the closets in order to allow full and efficient access to the closets by occupants of bedroom 18; the length dimension of the hallway's wall equals or exceeds the combined length of bedroom 18.

The fifth structural element presents as the placement of specifically configured laundry facility 14 in relationship to dual access closet 28, and the placement of specifically configured master bedroom 12 in relationship to the closet. Laundry facility 14 is placed on the side of dual access closet 28 that is opposite master bedroom 12. Specifically configured master bedroom 12 is placed on the side of dual access closet 28 opposite laundry facility 14. As a result, dual access closet 28 is placed between specifically configured laundry facility 14 and specifically configured master bedroom 12 in the manner described above and in such a manner that one side opens to the laundry facility and the other side opens to the master bedroom. The fifth structural element also presents as the placement of the laundry facility 14 in relationship to the dual access closet 30, and the placement of bedroom 16 in relationship to the dual access closet 30. Laundry facility 14 is placed on the side of dual access closet 30 that is opposite bedroom 16. Bedroom 16 is placed on the side of dual access closet 30 opposite laundry facility 14. Thus, dual access closet 30 is placed between the specifically configured laundry facility 14 and bedroom 16 in the manner described in the two preceding sentences and in such a manner that one side opens to laundry facility 14 and the other side opens to bedroom 16.

The fifth structural element also presents as the placement of laundry facility 14 in relationship to the dual access closet 32, and the placement of hallway 24*a* in relationship to the closet. Laundry facility 14 is placed on the side of dual access closet 32 that is opposite hallway 24*a*. Hallway 24*a* is placed on the side of dual access closet 32 opposite laundry facility 14. As a result, dual access closet 32 is located between specifically configured laundry facility 14 and hallway 24*a* in the manner described above and in such a manner that one side opens to laundry facility 14 and the other side opens to hallway 24*a*. Bedroom 18 is located on hallway 24*a* directly across from respective dual access closet 32. In another embodiment, kitchen 20 is located adjacent to stairway 48, the top of which is near laundry facility 14.

Figure 9:
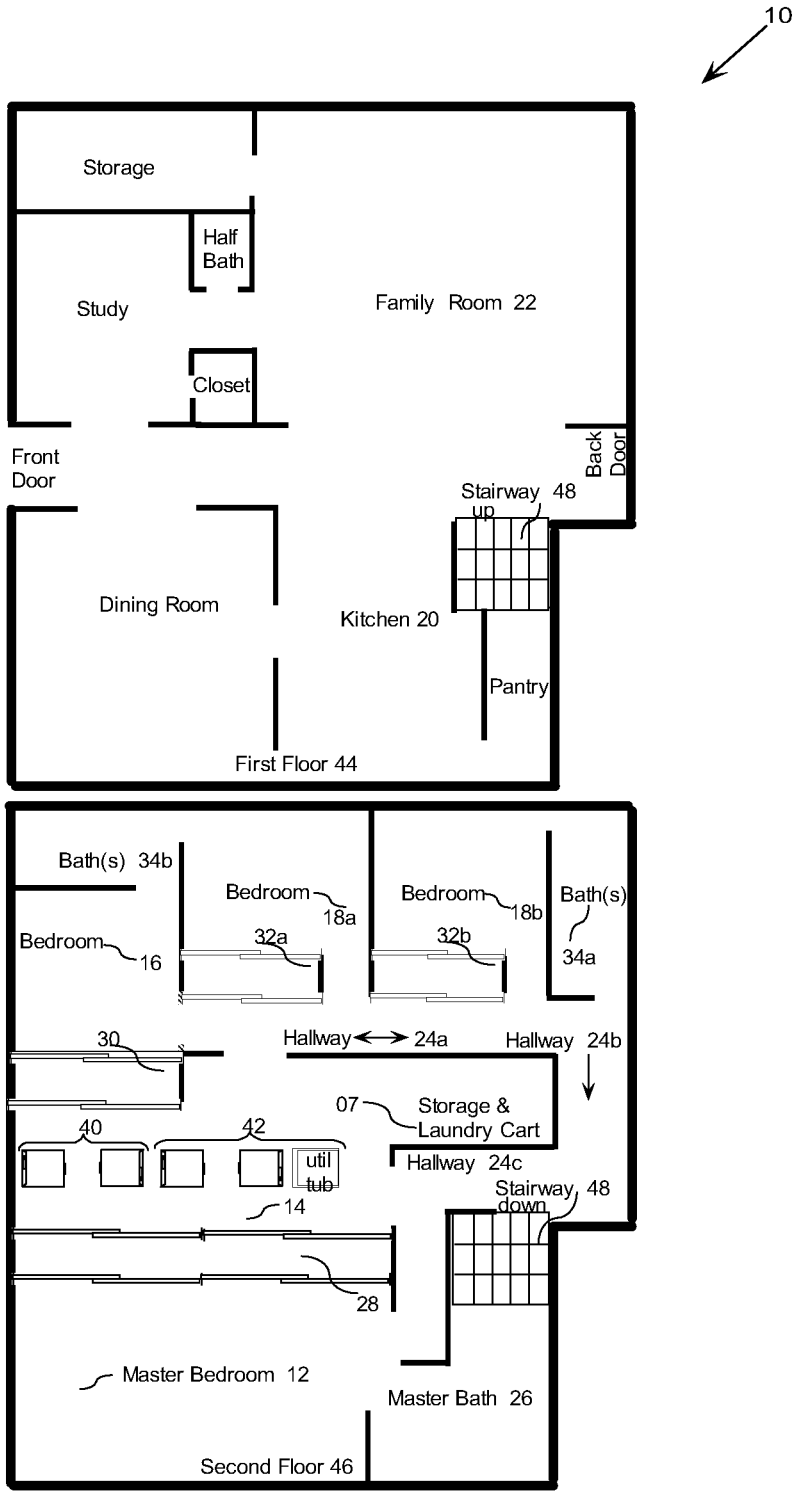
FIG. 9 is a top schematic view of another building structure arranged in accordance with an alternate embodiment of the present invention.

In another embodiment and referring to FIG. 9, building structure 10 is a two-story building structure, which includes dual access closets 28 and 30 adjacent to laundry facility 14 and dual access closets 32 across hallway 24*a* from laundry facility 14. It should be understood by one of ordinary skill in the art that the advantage of the presently described embodiment is that closets 32 are located within rooms 18 and that the disadvantage is that closets 32 are located across hallway 24*a* from laundry facility 14. It should also be understood that the other structural elements of building structure 10 are similar in construction and operation to those described above with respect to FIG. 8.

Figure 10:
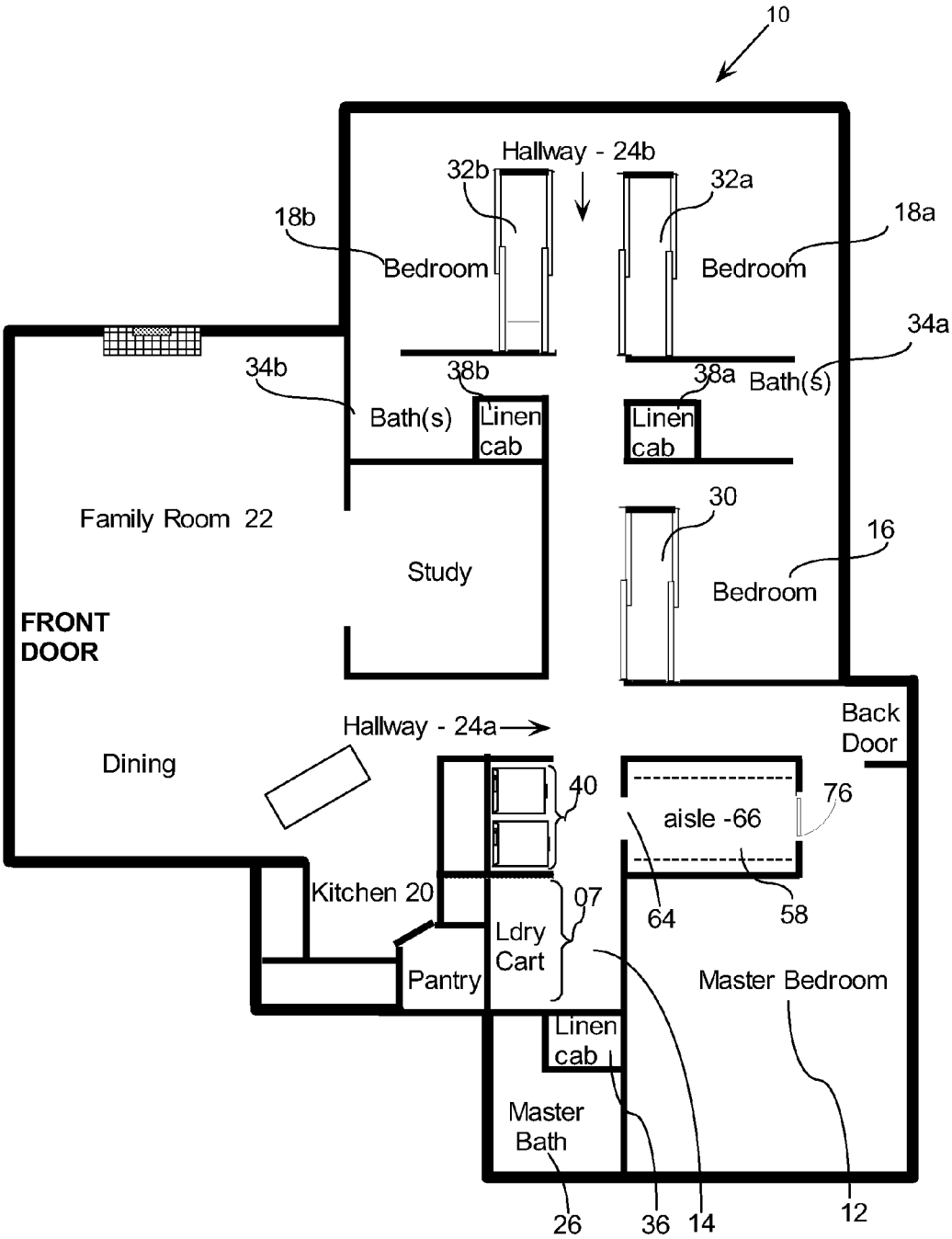
FIG. 10 is a top schematic view of another building structure arranged in accordance with an alternate embodiment of the present invention.

In another embodiment and referring to FIG. 10, building structure 10 includes laundry facility 14 coaxial with hallway 24*b*, which is common to laundry facility 14 and bedrooms 16 and 18. It should be understood by one of ordinary skill in the art that building structure 10 is beneficial for use of a laundry cart in that there would be no turns to make due to the fact that laundry facility 14 is in a straight line with hallway 24*b* common to laundry facility 14 and non-adjacent bedrooms 16 and 18.

The first structural element presents as walk-in dual access closet 58 and reach-in dual access closets 30 and 32. Additionally, dual access linen cabinets 36 and 38 are provided. The second structural element configures laundry facility 14 in a manner that allows full and efficient access to dual access closet 58 from laundry facility 14; thus opening 64 is provided in laundry facility 14 to allow full and efficient access to closet 58 by placing opening 64 in line with aisle 66 of closet 58 and in line with laundry equipment 40. Dual access linen closet 36 is provided adjacent to laundry facility 14 and master bathroom 12 to allow linens, such as towels and sheets, to be passed directly from laundry facility 14 to master bathroom 26.

To accommodate non-adjacent bedrooms 16 and 18 and closets 30 and 32, the second structural element configures hallway 24*b* to allow full and efficient access to dual access closets 30 and 32 from hallway 24*b*. Thus, the height of the wall in hallway 24*b* common to dual access closets 30 and 32 equals or exceeds the height of the respective closets' openings; the length of the specifically configured hallway equals or exceeds the combined length of bedroom 16, bathroom 34, and bedroom 18.

The third structural element presents as a relatively narrow configuration of specifically configured laundry facility 14. This narrow configuration allows dirty laundry to be collected from dual access closet 58 and made available to laundry equipment 40 with minimal or no steps. This relatively narrow configuration also allows clean laundry to be hung or stored into dual access closet 58 from laundry facility 14 with minimal or no steps. While a width of only three feet between laundry equipment 40 and a solid wall is sufficient for normal laundry processes and offers the greatest degree of laundry movement efficiency, a width of more than three feet may be preferred and is acceptable in the present invention.

The fourth structural element configures master bedroom 12, and bedrooms 16 and 18 in a manner that allows full and efficient access to respective dual access closets 58, 30, and 32. Thus, the wall in master bedroom 12 common to walk-in dual access closet 58 provides opening 76 in line with aisle 66 in order to allow full and efficient access to closet 58 by occupant(s) of master bedroom 12. The length and height dimensions of the respective walls in bedrooms 16 and 18 common to respective dual access closets 30 and 32 equal or exceed the length and height dimensions of the respective closets' openings in order to allow full and efficient access to the closets by the occupants of the respective bedrooms.

The fifth structural element presents as the placement of specifically configured laundry facility 14 in relationship to dual access closet 58, and the placement of specifically configured master bedroom 12 in relationship to dual access closet 58. Laundry facility 14 is placed on the side of dual access closet 58 that is opposite master bedroom 12. Master bedroom 12 is placed on the side of dual access closet 58 opposite laundry facility 14. As a result, dual access closet 58 is placed between specifically configured laundry facility 14 and specifically configured master bedroom 12 in the manner described above and in such a manner that one side opens to laundry facility 14 and the other side opens to master bedroom 12. In like manner, dual access linen cabinet 36 opens to laundry facility 14 on one side and master bathroom 26 on the other.

For the placement of hallway 24 in relationship to laundry facility 14, the fifth structural element presents as the placement of hallway 24*b* adjacent to laundry facility 14 in order to increase laundry movement efficiency. Dual access closets 30 and 32 are placed on hallway 24*b* near laundry facility 14 as are dual access linen cabinets 38. Hallway 24*b* is also placed in-line with laundry facility 14 rendering the structure ideal for the use of a laundry cart in that there would be no turns to make with the cart in order to access all dual access closets; therefore, laundry cart storage 07 is provided.

For the placement of hallway 24*b*, dual access closets 30 and 32, linen cabinets 38, and non-adjacent rooms 16, 18 and 34 in relationship to each other, the fifth structural element presents as follows: Hallway 24*b* is placed on the side of dual access closets 30 and 32 opposite respective bedrooms 16 and 18. Bedrooms 16 and 18 are placed on the respective side of dual access closets 30 and 32 opposite hallway 24*b*. As a result, dual access closets 30 and 32 are placed between the specifically configured hallway 24*b* and respective bedrooms 16 and 18 in the manner described above and in such a manner that one side opens to hallway 24*b* and the other side opens to respective bedrooms 16 and 18. In like manner, dual access linen cabinets 38 open to hallway 24*b* on one side and respective bathrooms 34 on the other.

Figure 11:
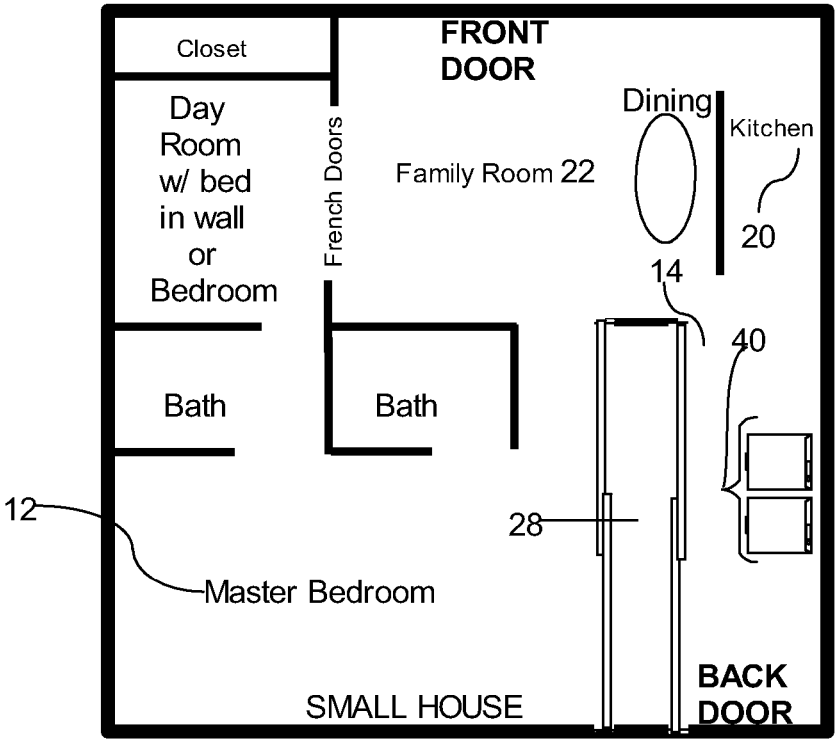
FIG. 11 is a top schematic view of another building structure arranged in accordance with an alternate embodiment of the present invention.

In another embodiment and referring to FIG. 11, a building structure 10 for a smaller house is shown including a single dual access closet 28. Structure and function of laundry facility 14, dual access closet 28 and master bedroom 12 are similar to those described in FIG. 1. In another embodiment, kitchen 20 is located adjacent to laundry facility 12.

Figure 12:
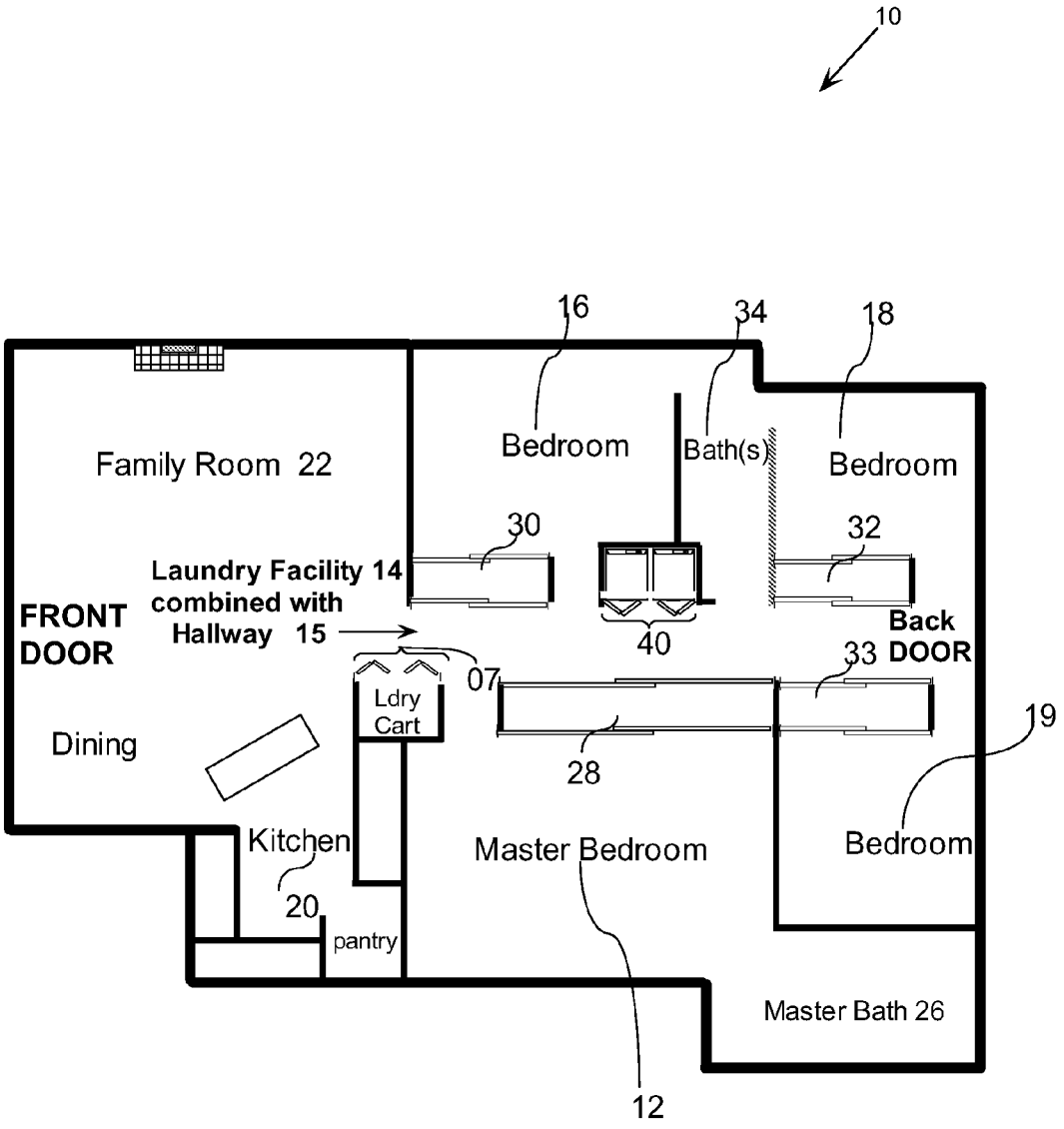
FIG. 12 is a top schematic view of another building structure arranged in accordance with an alternate embodiment of the present invention.

In another embodiment and referring to FIG. 12, a building structure 10 is disclosed where the laundry facility 14 and hallway 24 of other embodiments described above (e.g., FIG. 1) are combined into a single laundry facility hallway (indicated at 15 and referred to as "combined facility"). An advantage of the presently described embodiment is a reduction of square footage over structures with a separate laundry facility. Possible disadvantages of the presently described embodiment is a lack of room for storage of laundry supplies, lack of room for optional laundry equipment 42 (FIG. 1), congestion and clutter in combined facility 15 during the laundry process, the disturbance of occupants in adjacent rooms 16 and 34 by the sound produced by laundry equipment 40, as well as the significant distance between laundry equipment 40 and kitchen 20. This structure would require no turns for the use of a laundry cart to reach all dual access closets, and therefore, laundry cart storage 07 is provided.

The first structural element presents as dual access closets 28, 30, 32 and 33. The second structural element configures combined facility 15 in a manner that allows full and efficient access to dual access closets 28, 30, 32, and 33 from the combined facility. Thus, the height of the walls in combined facility 15 common to dual access closets 28, 30, 32, and 33 equals or exceeds the height of the respective closets' openings; the length of the specifically configured combined facility equals or exceeds the combined length of laundry cart closet 07, master bedroom 12, and bedroom 19.

The third structural element presents as a relatively narrow configuration of the combined facility 15. This narrow configuration allows dirty laundry to be collected from dual access closets 28, 30, 32, and 33 and made available to laundry equipment 40 with minimal or no steps. This relatively narrow configuration also allows clean laundry to be hung or stored into dual access closets 28, 30, 32, and 33 from combined facility 15 with minimal or no steps. While a width of only three feet between laundry equipment 40 and a solid wall is sufficient for normal laundry processes and offers the greatest degree of laundry movement efficiency, however, a width of more than three feet may be preferred and is acceptable in the present invention.

The fourth structural element configures master bedroom 12 and bedrooms 16, 18, and 19 in a manner that allows full and efficient access to respective dual access closets 28, 30, 32, and 33. Thus, the length and height dimensions of the respective walls in bedrooms 12, 16, 18, and 19 common to respective dual access closets 28, 30, 32, and 33 equal or exceed the length and height dimensions of respective closets' openings in order to allow full and efficient access to the closets by the occupants of the respective bedrooms.

The fifth structural element presents as the placement of the specifically configured combined facility 15 in relationship to dual access closets 28 and 33, and the placement of respective master bedroom 12 and bedroom 19 in relationship to the respective closets. Combined facility 15 is placed on the side of dual access closets 28 and 33 that is opposite respective master bedroom 12 and bedroom 19. Master bedroom 12 and bedroom 19 are placed on the respective side of dual access closets 28 and 33 opposite combined facility 15. As a result, dual access closets 28 and 33 are placed between combined facility 15 and master bedroom 12 and bedroom 19 in the manner described above and in such a manner that one side opens to combined facility 15 and the other side opens to the respective bedroom.

The fifth structural element also presents as the placement of specifically configured combined facility 15 in relationship to the dual access closets 30 and 32, and the placement of specifically configured bedrooms 16 and 18 in relationship to the respective closets. Combined facility 15 is placed on the side of dual access closets 30 and 32 opposite respective bedrooms 16 and 18. Bedrooms 16 and 18 are placed on the respective side of dual access closets 30 and 32 opposite combined facility 15. As a result, dual access closets 30 and 32 are placed between specifically configured combined facility 15 and respective bedrooms 16 and 18 in the manner described above and in such a manner that one side opens to combined facility 15 and the other side opens to the respective bedroom.

It should be understood that FIGS. 13, 14, 15, and 16 are offered as possible additions to the present invention, in that the other aspects of the invention can function without FIGS. 13, 14, 15, and 16. It should be further understood that FIGS. 13, 14, 15, and 16 operate independent of each other.

Figure 13:
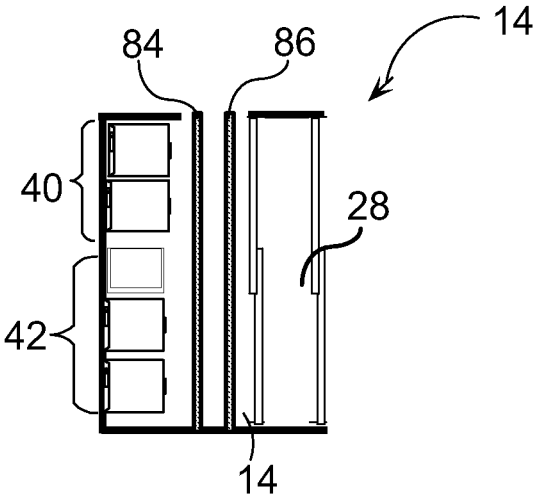
FIG. 13 is a top schematic view of a laundry facility of the building structure of FIG. 1.

Referring to FIG. 13, an overhead rod 84, either permanent or retractable, running length-wise through laundry facility 14 permits immediate hanging of clothes that are to be transferred to any non-adjacent closets. The quality of the laundry output benefits from the minimal amount of time that elapses between when laundry is removed from equipment 40 and hung on rod 84 thereby decreasing wrinkles in the laundry output. A second overhead rod 86 running parallel to rod 84 and several inches from rod 84 allows large items to be draped over both rods for drying. The purpose of rod 86 is to allow airflow to assist in the drying process and to prevent the large items from touching the floor. The double rod feature is particularly helpful for large items that cannot be placed in the dryer (of equipment 40), such as electric blankets. It should be understood by one of ordinary skill in the art that the number of hanging rods, such as rods 84 and 86, is variable based on the size and structure of laundry facility 14.

Figure 14:
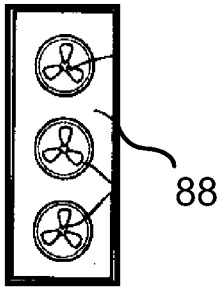
FIG. 14 is a top diagrammatic view of fans used in combination with the laundry facility of FIG. 13.

Referring to FIG. 14, a fan or multiple fans 88 may be placed in the closets described above (such as closet 28 of FIG. 1), preferably attached to the ceiling of the closets, or in laundry facility 14 (FIG. 1) to permit air drying of clothes.

Figure 15:
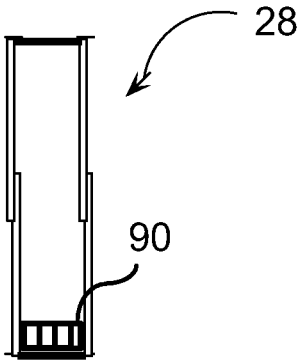
FIG. 15 is a top schematic view of a dual access closet of the building structure of FIG. 1.

Referring to FIG. 15, folding and transporting of laundry are further reduced by including shelving in the dual access closets described above, such as dual access closet 28 (FIG. 1). It should be understood by one of ordinary skill in the art that shelves 90 can be used in both reach-in and walk-in dual access closets. Shelving 90 accommodates laundry baskets and/or other containers for the sorting and storage of clean clothing and linens, such as underwear, socks, towels, washcloths, sheets, etc. This feature eliminates the need for folding the aforesaid items and conveniently places items in an accessible place for the end-user. The need for transporting these items is eliminated for dual access closets adjacent to laundry facility 14 (FIG. 1), such as closet 28 (FIG. 1), and minimized for the non-adjacent dual access closets, such as closet 30 (FIG. 1). Shelving 90 preferably has an adjustable height feature to accommodate the varying needs of end-users and may be placed in the closet(s) underneath or above hanging clothes or may run floor to ceiling, within or beside the closet(s), such as closet 28 (FIG. 1).

Figure 16:
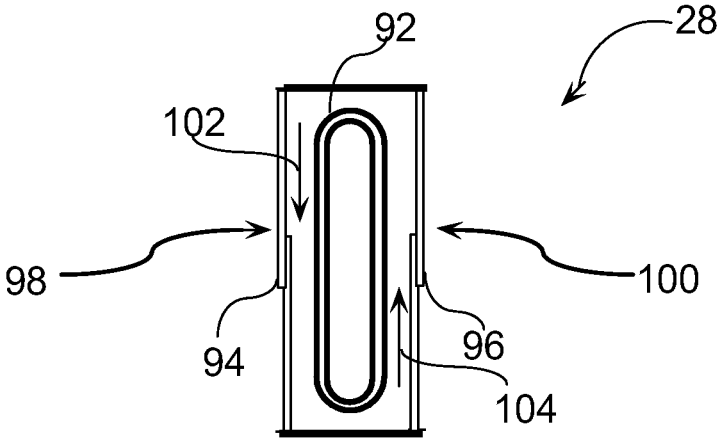
FIG. 16 is a top schematic view of a dual access closet of a building structure in accordance with an alternative embodiment of the present invention.

Referring to FIG. 16, in another embodiment of the present invention, a revolving hanger system 92 is disclosed and may be used in a dual access closet, such as closet 28 (FIG. 1). As described above with respect to FIG. 1, dual access closet 28 is located within a common wall adjacent to laundry facility 14 on one side and master bedroom 12 on the other. Door 94 opens to laundry facility 14 (FIG. 1) on one side, while door 96 opens to another room located opposite the common wall from the laundry facility. Although closet 28 opens to laundry facility 14 (FIG. 1) via door 94, it should be understood that closet 28 may be employed between a room and a common hallway. Doors 94 and 96 are depicted as sliding doors to closet 28, but it should be understood that the doors can be hinged, pocket doors, folding doors, etc., as long as the doors allow users to access the closet from opposite sides (denoted by arrows 98 and 100), respectively. Hangers holding clothes and other laundry can be placed on hanger system 92, which moves along a path within closet 28 (FIG. 1) as denoted by arrows 102 and 104. As a result, items placed on hanger system 92 from the right side of closet 28 (FIG. 1) as denoted by arrow 104 will move to counterclockwise along the path of the hanger system to the closet's left side as denoted by arrow 102 and vise versa. It should be understood by one of ordinary skill in the art that the manner of rotation of hanging system 92 can be altered depending on the size and structure of the rooms adjacent to the closet and the needs of the end-users. Therefore, clean laundry may be placed and organized on revolving hanger system 92 while standing in one spot from laundry facility 14 (FIG. 1), and an occupant of a room on the opposite side, such as master bedroom 12 (FIG. 1), may select from all the items on the revolving hanger system while standing in another spot. Dirty laundry may also be placed and organized on revolving hanger system 92 while standing in one spot and can also be collected while standing in another spot. As a result, the amount of time and labor required in the laundry process is optimized.

While one or more embodiments of the present invention have been described above, it should be understood that any and all equivalent realizations of the present invention are included within the scope and spirit thereof. Thus, the embodiments presented herein are by way of example only and are not intended as limitations of the present invention. Therefore, it is contemplated that any and all such embodiments are included in the present invention as may fall within the scope of the present invention.

What is claimed:

1. A building structure providing for improved laundry functions comprising:

a laundry facility having a washing machine for washing clothes;

a plurality of dual access closets, each of which having first and second accessible sides, wherein said first accessible side of each of said plurality of dual access closets opens directly to said laundry facility; and a plurality of rooms, wherein said second accessible side of each of said plurality of dual access closets opens directly to a respective one of said plurality of rooms:

wherein laundry items may be added and removed from either accessible side of each dual access closet.

2. The building structure of claim 1 further comprising:

a plurality of floors;

another dual access closet having a plurality of accessible sides, wherein laundry may be added and removed from either accessible side of the another dual access closet, wherein said laundry facility is located on one of said floors and said another dual access closet is located on another of said floors.

3. The building structure of claim 2, wherein said laundry facility is located in close proximity to said at least one stairwell.

4. The building structure of claim 3, wherein said another room is located in close proximity to said at least one stairwell.

5. The building structure of claim 1, wherein said laundry facility includes a plurality of laundry equipment.

6. The building structure of claim 5, wherein said laundry facility includes a storage area.

7. The building structure of claim 6, wherein said plurality of laundry equipment includes a removable laundry cart such that said cart is capable of being stored in said storage area.

8. The building structure of claim 1 further comprising:

another room selected from the group consisting of a kitchen, an office, and a workroom; and wherein said another room is in close proximity to said laundry facility.

9. The building structure of claim 8 further comprising:

a plurality of floors connected by at least one stairwell; and wherein said second another room is located on one of said floors and in close proximity to said at least one stairwell, and said laundry facility is located on another of said floors and in close proximity to said at least one stairwell.

10. The building structure of claim 1, wherein at least one of said plurality of dual access closets includes at least one shelf from which laundry items may be added and removed from either side of said at least one closet.

11. The building structure of claim 1, wherein said laundry facility includes at least one overhead rod for immediate hanging of some of the laundry items.

12. The building structure of claim 1, wherein at least one of said plurality of dual access closets includes a hanger system for rotating laundry items located in said closet.

13. The building structure of claim 1, wherein at least one of said plurality of dual access closets includes at least one fan for facilitating drying of laundry items.

14. The building structure of claim 1, wherein at least one of said plurality of dual access closets is selected from the group consisting of a walk-in closet and a reach-in closet.

15. A building structure providing for improved laundry functions comprising:

a laundry facility having a washing machine for washing clothes;

a first dual access closest having first closet first and second accessible sides, wherein said first closet first accessible side opens directly to the laundry facility;

a first room, wherein said first closet second accessible side opens directly to said first room;

at least one hallway, wherein an individual may walk directly from said laundry facility to said at least one hallway without passing through another room;

a second dual access closet having second closet first and second accessible sides, wherein said second closet first accessible side opens directly to said at least one hallway; and a second room, wherein said second closet second accessible side opens directly to said second room, wherein laundry items may be added or removed from either accessible side of said first and second dual access closets.

16. The building structure of claim 15, wherein at least one of said first and second dual access closets includes at least one shelf from which the laundry items may be added and removed from either accessible side of said at least one closet.

17. The building structure of claim 15, wherein said laundry facility includes at least one overhead rod for immediate hanging of some of the laundry items.

18. The building structure of claim 15, wherein at least one of said first and second dual access closets includes a hanger system for rotating some of the laundry items located in said at least one closet.

19. The building structure of claim 15, wherein at least one of said first and second dual access closets includes at least one fan for facilitating drying of the laundry items.

20. The building structure of claim 15, wherein said second dual access closet is selected from the group consisting of a walk-in closet and a reach-in closet.

21. A building structure providing for improved laundry functions comprising:

a laundry facility having a washing machine for washing clothes;

at least one dual access closet having first and second accessible sides, wherein said first accessible side opens directly to said laundry facility;

a first room, wherein said second accessible side opens directly to said first room so that items may be added or removed from either accessible side of said at least one dual access closet; and a second room, wherein an individual may walk directly from said laundry facility to said second room without passing through another room and wherein the second room is selected from the group consisting of a kitchen, an office, and a workroom.

* * * * *

UNITED STATES PATENT AND TRADEMARK OFFICE

CERTIFICATE OF CORRECTION

PATENT NO. : 9,109,375 B2
APPLICATION NO. : 11/690545
DATED : August 18, 2015
INVENTOR(S) : Bonnie C. Martin and James Martin It is certified that error appears in the above-identified patent and that said Letters Patent is hereby corrected as shown below:

In the Claims

In Claim 15, column 15, line 30, please replace the word "closest" with --closet--.

Signed and Sealed this
Fifteenth Day of March, 2016

Michelle K. Lee

Michelle K. Lee
*Director of the United States Patent and Trademark Office*